US008056673B2

(12) United States Patent
Zelinski

(10) Patent No.: US 8,056,673 B2
(45) Date of Patent: Nov. 15, 2011

(54) SOUND DAMPENING AND WEAR PROTECTING FLAPPER CONFIGURATION FOR MARINE EXHAUST SYSTEM

(75) Inventor: Joseph R. Zelinski, Oshkosh, WI (US)

(73) Assignee: CompX International Inc., Greenville, SC (US)

( * ) Notice: Subject to any disclaimer, the term of this patent is extended or adjusted under 35 U.S.C. 154(b) by 0 days.

(21) Appl. No.: 12/835,061

(22) Filed: Jul. 13, 2010

(65) Prior Publication Data

US 2011/0011669 A1 Jan. 20, 2011

Related U.S. Application Data

(60) Provisional application No. 61/225,381, filed on Jul. 14, 2009.

(51) Int. Cl.

| | |
|---|---|
| ***F01N 13/12*** | (2010.01) |
| ***F01N 1/16*** | (2010.01) |
| *F01N 13/00* | (2010.01) |
| *F16K 17/02* | (2006.01) |
| *F16K 17/04* | (2006.01) |

(52) U.S. Cl. ..... 181/235; 181/237; 181/227; 440/89 E

(58) Field of Classification Search ..... 181/235, 181/233, 237, 227, 228, 254; 60/322; 251/87; 137/527.6; 440/89 E, 89 R See application file for complete search history.

(56) References Cited

U.S. PATENT DOCUMENTS

| | | | | |
|---|---|---|---|---|
| 928,481 | A * | 7/1909 | Tenold et al. | 210/131 |
| 2,169,123 | A * | 8/1939 | Galusha | 220/89.2 |
| 2,838,062 | A * | 6/1958 | Held et al. | 137/382 |
| 3,206,836 | A | 9/1965 | Schlussler | |
| 3,470,690 | A | 10/1969 | Thompson | |
| 3,788,072 | A * | 1/1974 | Burger | 60/324 |
| 3,842,722 | A * | 10/1974 | Miller | 454/359 |
| 4,714,443 | A | 12/1987 | Chaplin et al. | |
| 4,779,704 | A | 10/1988 | Akiyama | |
| 4,787,869 | A * | 11/1988 | Shiozawa | 440/89 R |
| 5,046,408 | A * | 9/1991 | Eugenio | 454/359 |
| 5,148,675 | A | 9/1992 | Inman | |
| 5,299,961 | A * | 4/1994 | Okamoto | 440/89 R |
| 5,591,058 | A | 1/1997 | Schriever et al. | |
| 5,647,395 | A * | 7/1997 | Hashimoto et al. | 137/517 |
| 5,739,483 | A | 4/1998 | Yashiro et al. | |
| 5,848,615 | A * | 12/1998 | Conti et al. | 137/856 |
| 6,035,633 | A | 3/2000 | Woods | |
| 6,038,855 | A | 3/2000 | Markström et al. | |
| 6,065,564 | A * | 5/2000 | Uegane | 181/237 |
| 6,205,778 | B1 | 3/2001 | Akaba et al. | |

(Continued)

FOREIGN PATENT DOCUMENTS

JP 10141041 A * 5/1998

*Primary Examiner* — Edgardo San Martin
(74) *Attorney, Agent, or Firm* — Dority & Manning, P.A.

(57) ABSTRACT

Disclosed are apparatus and methodology for reducing noise and wear in a flapper configured exhaust tip for a marine exhaust system. A metallic flapper is located at an end portion of an exhaust tip of the exhaust pipe. An elastomeric flapper assembly is provided covering the exhaust tip and includes a lip portion configured to provide noise reduction by functioning as a stop for a tip portion of the metallic flapper. The metallic flapper is positioned such that a tip thereof contacts the elastomeric flapper assembly rather than the metallic exhaust pipe. Such contact with an elastomeric flapper assembly reduces noise previously produced by flapper contact with the hot exhaust pipe.

12 Claims, 2 Drawing Sheets

U.S. PATENT DOCUMENTS 6,213,828 B1 * 4/2001 Tsumiyama et al. ..... 440/89 R
6,234,195 B1 * 5/2001 Kippe et al. ..... 137/493.3
6,240,957 B1 * 6/2001 Hattori ..... 137/527.6
6,397,589 B1 6/2002 Beson et al.
6,487,854 B2 12/2002 Maus
6,609,590 B2 8/2003 Zelinski
6,722,126 B2 4/2004 Kawamizu
6,739,922 B2 * 5/2004 Matsuda ..... 440/89 E
6,766,823 B2 * 7/2004 Hong ..... 137/514
6,918,246 B2 7/2005 Fukumoto et al.
7,013,565 B1 3/2006 Zelinski
7,052,343 B2 5/2006 Ozaki et al.
7,066,296 B2 * 6/2006 Uegane et al. ..... 181/254
7,104,359 B1 9/2006 Zelinski
7,240,768 B2 * 7/2007 Sageman ..... 181/237
7,347,045 B2 3/2008 Bozmoski et al.
7,827,690 B1 11/2010 Zelinski
7,913,809 B2 3/2011 Zelinski
2002/0104708 A1 8/2002 Zelinski
2007/0107981 A1 5/2007 Sicotte
2007/0181362 A1 * 8/2007 Champney et al. ..... 181/227
2007/0209353 A1 9/2007 Zelinski
2010/0012422 A1 1/2010 Zelinski
2010/0229858 A1 * 9/2010 Wheelwright ..... 128/201.11
2010/0261393 A1 * 10/2010 Kazuta ..... 440/89 E

* cited by examiner

SOUND DAMPENING AND WEAR PROTECTING FLAPPER CONFIGURATION FOR MARINE EXHAUST SYSTEM

PRIORITY CLAIM

This application claims the benefit of previously filed U.S. Provisional Patent Application entitled "SOUND DAMPENING FLAPPER CONFIGURATION FOR MARINE EXHAUST SYSTEM," assigned U.S. Ser. No. 61/225,381, filed Jul. 14, 2009, and which is incorporated herein by reference for all purposes.

FIELD OF THE INVENTION

The present subject matter relates to exhaust systems. More specifically, the present subject matter discloses methods and apparatus for reducing wear and noise generation as associated with a marine exhaust system.

BACKGROUND OF THE INVENTION

Water cooled marine exhaust systems have been previously employed to generally good effect, but have nevertheless possessed certain operational deficiencies. Prior exhaust tips have included various flapper configurations that are typically positioned downstream of a point at which cooling water flow mixes with exhaust gasses. Under normal operation, such positioning of exhaust flappers works well, but issues may arise upon generation of excessive heat levels within the exhaust systems.

In particular, flappers in such systems are often provided with sealing elastomeric, i.e., rubber, material along the edges of the perimeter of the flapper. With continued presence of excessive heat, as for example, from prolonged absence or reduction of cooling fluid, such elastomeric seals may become damaged to the point that direct metal-to-metal contact between the flapper and internal surfaces of the exhaust tips may occur. Such metal-to-metal contact may easily result in significant damage to the flapper as well as the exhaust tip. Additionally, such metal-to-metal contact often results in excessive noise generation during certain operational phases of the marine engine.

Various patents are known concerning marine exhaust related subject matter, including for example Zelinski U.S. Pat. No. 7,104,359 entitled "Muffler having a baffle with angled plates;" Zelinski U.S. Pat. No. 7,013,565 entitled "Removable collector for liquid cooled exhaust;" Zelinski U.S. Pat. No. 6,609,590 entitled "Exhaust system having angled baffle;" and Beson et al. U.S. Pat. No. 6,397,589 entitled "Exhaust pipes and assemblies." The disclosures of all the patents cited herein are hereby incorporated by reference for all purposes.

In light of such deficiencies recognized herewith in the known exhaust tip flapper configurations, it would be desirable to provide a flapper configuration that avoids such heat damage, and provides possibilities for reduced noise generation.

While various configurations of marine exhaust flapper arrangements have been developed, no design has emerged that generally encompasses all of the desired characteristics as hereafter presented in accordance with the subject technology.

SUMMARY OF THE INVENTION

In view of the recognized features encountered in the prior art and addressed by the present subject matter, improved methodologies for providing both noise reduction and reduced flapper wear have been developed. It should be understood that the present subject matter equally encompasses both methodologies and corresponding apparatuses.

In an exemplary configuration, previously provided exhaust flappers haves been relocated to significantly reduce noise as well as wear potential.

In one exemplary form, the present subject matter provides an exhaust flapper located in an exhaust system generally upstream of previously designated locations.

In accordance with aspects of certain embodiments of the present subject matter, an exhaust flapper is located proximate an end point of an exhaust tip.

In accordance with certain aspects of other embodiments of the present subject matter, methodologies have been developed to reduce noise by positioning a flapper such that a portion thereof will, with normal movement, contact a sound-deadening surface.

In accordance with aspects of still further embodiments of the present subject matter, a flapper may be positioned to contact an elastomeric component to reduce contact generated noise.

One present exemplary embodiment relates to a flapper configuration for a marine exhaust system of the type having an exhaust pipe which has an exhaust tip with a pivot-mounted metallic flapper received therein. Such a present exemplary configuration comprises an elastomeric main body portion supported on such exhaust tip, an elastomeric lid portion, and a live hinge. Preferably, such live hinge joins such lid portion with such body portion such that such lid portion covers such metallic flapper, and such that such metallic flapper contacts such elastomeric lid portion during pivoting of such metallic flapper. With such exemplary present configuration, wear is reduced on such metallic flapper and sound is deadened in association with such contact.

In one exemplary alternative such flapper arrangement, an elastomeric lip portion may be included, defined by a face of such elastomeric body portion facing such lid portion, for receiving such lid portion whenever such flapper configuration is closed. In another present alternative of such exemplary flapper arrangement, such main body portion and such lip portion may both be annular.

Still further, in another present exemplary alternative for some embodiments, such exhaust pipe and such exhaust tip may comprise metal, and such elastomeric portions may comprise rubber. Another present exemplary exhaust system may comprise an exhaust pipe; a mounting flange secured on such exhaust pipe relatively adjacent an end thereof; an exhaust tip formed between such mounting flange and such end of such exhaust pipe; a metallic flapper pivotally mounted in such exhaust tip, so as to pivot in response to exhaust gases received there against from such exhaust pipe; and an elastomeric flapper arrangement. Preferably, such elastomeric flapper arrangement covers such exhaust tip, and is in contact with such metallic flapper in predetermined pivoted positions of such metallic flapper, for reducing contact wear and contact sound therewith.

In one exemplary alternative embodiment, such elastomeric flapper arrangement may include an elastomeric main body portion supported on such exhaust tip, an elastomeric lid portion, and a live hinge joining such lid portion with such body portion such that such lid portion covers such metallic flapper.

In another present alternative of such exemplary exhaust system, such exhaust system may comprise a marine exhaust system; and such elastomeric flapper arrangement may comprise a unitary device having a generally cylindrical main body portion configured to fit over such exhaust tip, and a lid portion configured to close over such exhaust tip so as to cover a portion of such main body portion during periods of very low or no exhaust gas flow through such marine exhaust system.

In yet further present alternatives, an exemplary such exhaust pipe may comprise an annular metallic pipe for a marine exhaust system; and such main body portion of such elastomeric flapper arrangement may be annular and form an annular lip portion for resting receipt of such lid portion thereon. Still further, such mounting flange may form openings therein for mounting of such exhaust pipe; and such exhaust tip may include a mounting pin received therein, for pivoting receipt of such metallic flapper. In some present alternatives, such elastomeric flapper arrangement may comprise rubber.

It should be understood by those of ordinary skill in the art that the present subject matter equally pertains to both apparatus and corresponding and/or related methodology. One present exemplary methodology involves reducing noise and wear on an exhaust system of the type having an exhaust pipe which has an exhaust tip with a pivot-mounted metallic flapper received therein, for pivoting in response to exhaust gases passing out such exhaust tip. Such methodology preferably comprises providing an elastomeric main body portion supported on such exhaust tip; providing an elastomeric lid portion; and joining such lid portion and such body portion with a live hinge, such that such elastomeric lid portion covers such metallic flapper for contact therewith during pivoting of such metallic flapper. Per such present exemplary methodology, contact between such metallic flapper and such elastomeric lid portion reduces wear on such metallic flapper and deadens sound associated with such contact.

In present variations of such methodology, in some instances such elastomeric portions may comprise rubber. In further present alternatives, such exhaust pipe may comprise an annular metallic pipe of a marine exhaust system; and such elastomeric main body portion may be annular and form an annular lip portion for resting receipt of such lid portion thereon.

Additional objects and advantages of the present subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the present subject matter without departing from the spirit and scope of the present subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
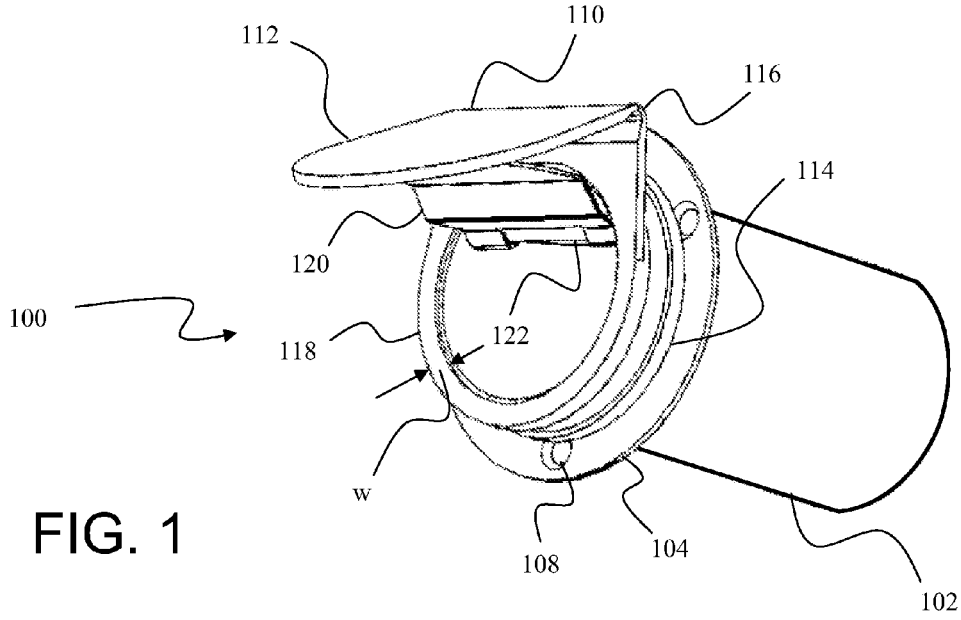
FIG. 1 illustrates an exemplary exhaust and flapper configuration in accordance with present technology with the exemplary flapper thereof in what is presently referenced as an open position.

Repeat use of reference characters throughout the present specification and appended drawings is intended to represent same or analogous features, elements, or steps of the present subject matter. It should be appreciated that the various illustrations are not intended as being drawn to the same scale but are variously sized to better comprehend selected aspects of components illustrated.

DETAILED DESCRIPTION OF THE PREFERRED EMBODIMENTS

As discussed in the Summary of the Invention section, the present subject matter is particularly concerned with improved flapper configurations for use with marine exhaust systems.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Detailed reference is made herein to exemplary presently preferred embodiments of the subject marine exhaust flapper configurations. First with reference to present FIG. 1, an exemplary exhaust and flapper configuration in accordance with present technology is described with the exemplary flapper thereof in a defined open position.

As shown in FIG. 1, an exemplary flapper configuration generally 100 is illustrated. An exhaust tip (not visible in FIG. 1) is covered with an elastomeric flapper arrangement 110 having mounted therein a metallic flapper 120 by way of pivot device 122 mounted within the exhaust tip. Elastomeric flapper arrangement 110 generally corresponds to a unitary device having a generally cylindrical main body portion 114 configured to fit over the exhaust tip, and having a lid portion 112 configured to close over the exhaust tip so as to cover a portion of the main body portion 114 during periods of very low or no exhaust gas flow. Elastomeric flapper 112 is coupled to the main body portion 114 of elastomeric flapper arrangement 110 by way of a live hinge 116.

Generally, per present subject matter, the elastomeric material from which flapper arrangement 110 is constructed provides some exhaust sealing properties by way of lid portion 112 as well as some noise reduction capabilities. More particularly with respect to noise reduction capabilities, it should be appreciated that main body portion 114 of flapper arrangement 110 preferably includes a lip portion 118 having a dimension "w" (illustrated between unmarked opposing arrows in FIG. 1) which is configured to provide a stop or contact portion for metallic flapper 120. As illustrated per the present exemplary embodiment, such lip portion 118 preferably is generally annular in shape, although other shapes may be practiced in accordance with the present subject matter.

Figure 2:
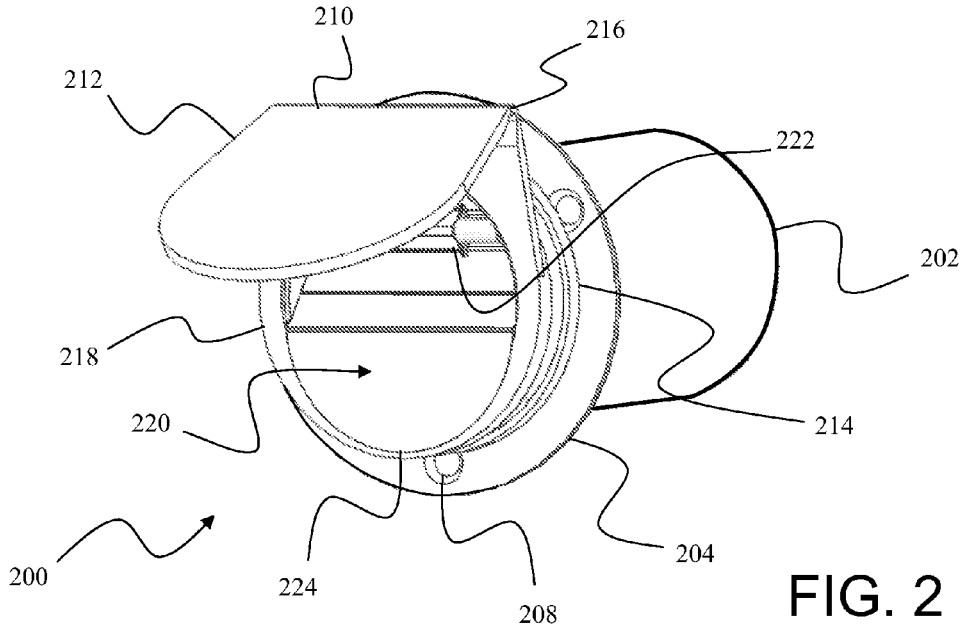
FIG. 2 illustrates a left oblique view of an exemplary exhaust and flapper configuration in accordance with present technology with the exemplary flapper thereof in what is presently referenced as a closed position.
Figure 3:
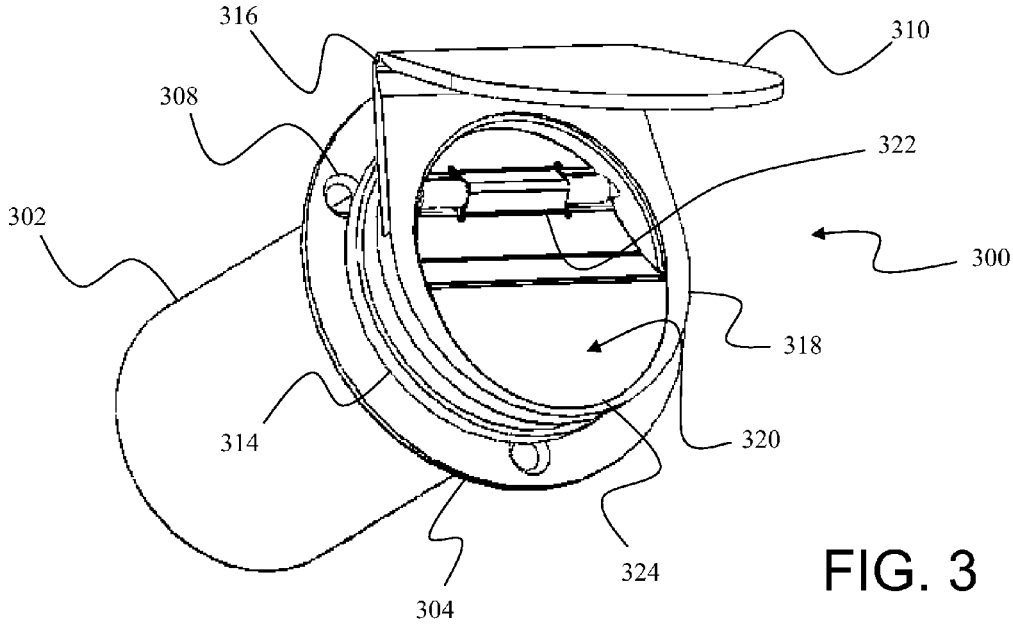
FIG. 3 illustrates a right oblique view of an exemplary exhaust and flapper configuration in accordance with present technology with the exemplary flapper thereof in what is presently referenced as a closed position.

With more particular reference to present FIGS. 2 and 3, the operational aspects of the present subject matter may be further appreciated with reference to present exemplary flapper assemblies generally 200, 300. As may be seen in FIGS. 2 and 3, respective exemplary metallic flappers 220, 320 have been repositioned from previously known positions to a position downstream of the exhaust system associated with a marine engine (not separately illustrated herewith, and details of which are either well known to those of ordinary skill in the art, or form no particular part of the present disclosure).

More specifically, exemplary flappers 220, 320 may be positioned within an end portion of exemplary exhaust pipe portions 202, 302 that are respectively covered by cylindrical main body portions 214, 314. Exemplary flappers 220, 320 may be mounted therein by way of respective pivot devices 222, 322 such that respective tip portions 224, 324 of flappers 220, 320 contact respective lip portions 218, 318 of flapper arrangements 214, 314.

By mounting flappers 220, 320 in the respective exhaust tips in such a manner, metallic flappers 220, 320 may contact an external surface portion of respective elastomeric flapper arrangements 210, 310, thereby avoiding potential direct contact respectively between flappers 220, 320 and any metallic portions of the associated exhaust tips.

It should further be appreciated by those of ordinary skill in the art based on the disclosure herewith that even under circumstances such that the subject elastomeric portions should deteriorate due to extreme heat levels within the exhaust system, noise levels will remain relatively low per present subject matter due to avoidance of metal-to-metal contact, as may otherwise occur in various known previous configurations.

Figure 4:
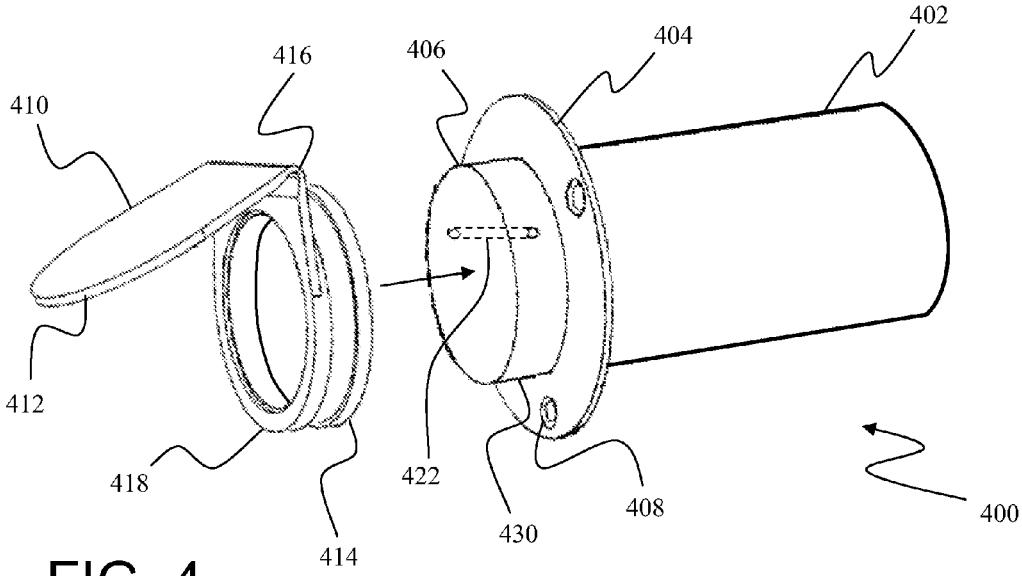
FIG. 4 illustrates an exploded partial view of an exemplary assembly in accordance with present technology.

With reference to present FIG. 4, there is illustrated an exploded partial view of a presently exemplary assembly generally 400 in accordance with present technology. As may be seen in FIG. 4, elastomeric flapper assembly 410 includes a main body portion 414 and a lid portion 412. Lid portion 412 is coupled to main body portion 414 by way of a live hinge 416. Also illustrated is a portion of an exemplary exhaust pipe 402 with which the present subject matter may be practiced, and including an exemplary mounting flange 404 secured to one end thereof. Mounting flange 404 may be secured to exhaust pipe 402 in any suitable manner including, but not limited to, welding.

With further reference to FIG. 4, it will be seen that flange 404 includes a representative number of mounting holes 408 positioned in the periphery thereof for securing the exhaust pipe to a suitable portion of a boat or ship's exterior. The precise number, location, and type of such attachment features may be varied in order to best accommodate the needs of particular embodiments and implementations of the present subject matter.

It may be further observed that flange 404 is positioned back from the end of exhaust pipe 402 so as to provide or form an exhaust tip generally 430 on which exemplary elastomeric flapper assembly 410 may be mounted. It will be appreciated that while for clarity no metallic flapper has been illustrated in Figure, a mounting pin 422 as would be associated with such a flapper is illustrated in phantom. Accordingly, such exemplary mounting pin 422 partially illustrates pivot devices 122, 222, 322 previously illustrated in FIGS. 1-3, respectively.

Those of ordinary skill in the art will appreciate that exhaust gas flow from the marine engine, not separately illustrated, provides a force that will open both the elastomeric flappers 110, 210, 310, 410 and the metallic flappers 120, 220, 320, 420. Absent such exhaust gas flow, both flappers will close.

It should be noted with respect to FIG. 3 that representative elastomeric flapper 310 is shown in an open position only as a means to illustrate more clearly the position of metallic flapper 320 and, in particular, the position of the tip portion 324 of metallic flapper 320 in contact with lip 318 of elastomeric flapper assembly 314. Such a positioning of elastomeric flapper 310 would not normally occur during practice as it too would be closed when metallic flapper 320 is closed, as should be understood by those of ordinary skill in the art per the totality of the disclosure herewith.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, the scope of the present disclosure is intended by way of example rather than by way of limitation. Accordingly, the subject disclosure does not preclude inclusion of such modifications, variations, and/or additions to the present subject matter as would be readily apparent to one of ordinary skill in the art.

What is claimed is:

1. A flapper configuration for a marine exhaust system of the type having an exhaust pipe which has an exhaust tip with a pivot-mounted metallic flapper received therein, comprising:

an elastomeric main body portion supported on such exhaust tip;

an elastomeric lid portion; and a live hinge, joining said lid portion with said body portion such that such lid portion covers such metallic flapper, and such that such metallic flapper contacts said elastomeric lid portion during pivoting of such metallic flapper, so as to reduce wear on such metallic flapper and so as to deaden sound associated with such contact.

2. A flapper arrangement as in claim 1, further including an elastomeric lip portion defined by a face of said elastomeric body portion facing said lid portion, for receiving said lid portion whenever said flapper configuration is closed.

3. A flapper arrangement as in claim 2, wherein said main body portion and said lip portion are both annular.

4. A flapper arrangement as in claim 1, wherein such exhaust pipe and such exhaust tip comprise metal, and said elastomeric portions comprise rubber.

5. An exhaust system, comprising:

an exhaust pipe;

a mounting flange secured on said exhaust pipe relatively adjacent an end thereof;

an exhaust tip formed between said mounting flange and said end of said exhaust pipe;

a metallic flapper pivotally mounted in said exhaust tip, so as to pivot in response to exhaust gases received thereagainst from said exhaust pipe; and an elastomeric flapper arrangement, covering said exhaust tip, and in contact with said metallic flapper in predetermined pivoted positions of said metallic flapper, for reducing contact wear and contact sound therewith;

wherein said elastomeric flapper arrangement includes an elastomeric main body portion supported on such exhaust tip, an elastomeric lid portion, and a live hinge joining said lid portion with said body portion such that such lid portion covers such metallic flapper.

6. An exhaust system as in claim 5, wherein:

said exhaust system comprises a marine exhaust system;

said elastomeric flapper arrangement comprises a unitary device having a generally cylindrical main body portion configured to fit over said exhaust tip; and said lid portion is configured to close over said exhaust tip so as to cover a portion of said main body portion during periods of very low or no exhaust gas flow through said marine exhaust system.

7. An exhaust system as in claim 5, wherein:

said exhaust pipe comprises an annular metallic pipe for a marine exhaust system; and said main body portion of said elastomeric flapper arrangement is annular and forms an annular lip portion for resting receipt of said lid portion thereon.

8. An exhaust system as in claim 5, wherein:

said mounting flange forms openings therein for mounting of said exhaust pipe; and said exhaust tip includes a mounting pin received therein, for pivoting receipt of said metallic flapper.

9. An exhaust system as in claim 5, wherein said elastomeric flapper arrangement comprises rubber.

10. Methodology for reducing noise and wear on an exhaust system of the type having an exhaust pipe which has an exhaust tip with a pivot-mounted metallic flapper received therein, for pivoting in response to exhaust gases passing out such exhaust tip, comprising:

providing an elastomeric main body portion supported on such exhaust tip;

providing an elastomeric lid portion; and joining said lid portion and said body portion with a live hinge, such that such elastomeric lid portion covers such metallic flapper for contact therewith during pivoting of such metallic flapper, whereby contact between such metallic flapper and said elastomeric lid portion reduces wear on such metallic flapper and deadens sound associated with such contact.

11. Methodology as in claim 10, wherein said elastomeric portions comprise rubber.

12. Methodology as in claim 10, wherein:

such exhaust pipe comprises an annular metallic pipe of a marine exhaust system; and said elastomeric main body portion is annular and forms an annular lip portion for resting receipt of said lid portion thereon.

* * * * *